US007801479B2

(12) United States Patent
Jeong

(10) Patent No.: US 7,801,479 B2
(45) Date of Patent: Sep. 21, 2010

(54) METHOD FOR RECEIVING DIGITAL MULTIMEDIA BROADCASTING IN A WEAK ELECTROMAGNETIC FIELD REGION AND AN APPARATUS THEREFOR

(75) Inventor: Ji-Min Jeong, Seoul (KR)

(73) Assignee: Samsung Electronics Co., Ltd (KR)

( * ) Notice: Subject to any disclaimer, the term of this patent is extended or adjusted under 35 U.S.C. 154(b) by 775 days.

(21) Appl. No.: 11/633,782

(22) Filed: Dec. 5, 2006

(65) Prior Publication Data

US 2007/0130606 A1 Jun. 7, 2007

(30) Foreign Application Priority Data

Dec. 5, 2005 (KR) ..... 10-2005-0117732

(51) Int. Cl.
*H04H 40/00* (2008.01)

(52) U.S. Cl. ..... 455/3.06; 455/312

(58) Field of Classification Search ..... 455/3.02, 455/3.06, 561, 450, 560, 436, 54.1, 12.1, 455/62, 89

See application file for complete search history.

(56) References Cited

U.S. PATENT DOCUMENTS 5,535,430 A * 7/1996 Aoki et al. ..... 455/552.1
6,993,283 B1 * 1/2006 Ka Ming et al. ..... 455/3.01
7,242,965 B2 * 7/2007 Lin et al. ..... 455/561
2004/0022326 A1 * 2/2004 Morrish et al. ..... 375/316

FOREIGN PATENT DOCUMENTS

| | | |
|---|---|---|
| CN | 1697499 | 11/2005 |
| KR | 1020000034637 | 6/2000 |
| KR | 20-0378626 | 3/2005 |
| KR | 1020050108220 | 11/2005 |
| WO | WO 2004/107607 | 9/2004 |

* cited by examiner

*Primary Examiner*—Tu X Nguyen
(74) *Attorney, Agent, or Firm*—The Farrell Law Firm, LLP

(57) ABSTRACT

Disclosed is a method for receiving DMB services with a DMB receiving apparatus capable of operating both in first DMB receiving mode and in second DMB receiving mode in a weak electromagnetic field region. The method includes setting the DMB receiving apparatus to the first DMB receiving mode both to receive first DMB packet data and to detect second DMB packet data, checking detection of the second DMB packet data if an event occurs preventing reception of the first DMB packet data during the first DMB receiving mode, notifying the user of the DMB receiving apparatus of possibility of switching the apparatus from the first to the second DMB receiving mode if the second DMB packet data is detected, and switching the DMB receiving apparatus from the first to the second DMB receiving mode according to a user switching request.

23 Claims, 4 Drawing Sheets

METHOD FOR RECEIVING DIGITAL MULTIMEDIA BROADCASTING IN A WEAK ELECTROMAGNETIC FIELD REGION AND AN APPARATUS THEREFOR

PRIORITY

This application claims priority under 35 U.S.C. §119 to an application entitled "Method for Receiving Digital Multimedia Broadcasting in a Weak Electromagnetic Field Region and an Apparatus therefor" filed in the Korean Intellectual Property Office on Dec. 5, 2005 and assigned Ser. No. 2005-0117732, the contents of which are incorporated herein by reference.

BACKGROUND OF THE INVENTION

1. Field of the Invention

The present invention relates to a method and apparatus for receiving DMB (Digital Multimedia Broadcasting) services, and more particularly to a method and apparatus for effectively receiving DMB services even in a weak electromagnetic field region.

2. Description of the Related Art

DMB services represent the next generation digital broadcasting services to enable the user to enjoy high quality multichannel multimedia broadcasting. These DMB services may be provided through a variety of wireless communications sets such as a mobile terminal, vehicle-mounted wireless terminal, and home based television set. DMB services are generally divided into satellite DMB and terrestrial DMB according to the method of transmitting information. Satellite DMB utilizes satellite communications to enable subscribers to freely enjoy various multimedia contents through wireless terminals with a directional antenna, such as a personal mobile terminal and a vehicle-mounted wireless terminal, while they are moving outdoors. Terrestrial DMB generally provides multimedia services through the allotted frequencies of 204 to 210 MHz, VHF band corresponding to TV Channel Number 12.

Referring to FIG. 1, which illustrates a conventional DMB system, satellite DMB services are provided by satellite DMB center 102 to send DMB signals of 13.824 to 13.883 GHz to satellite 100, which in turn sends TDM (Time Division Multiplex) signals of 12.214 to 12.239 GHz for the terrestrial radio station 104 and signals of 2.630 to 2.665 GHz directly for a personal wireless terminal. The terrestrial radio station 104 is a system for providing the radio signals to a wireless terminal existing in a region not capable of receiving the signals directly from the satellite. Namely, the terrestrial radio station 104, acting as gap filler, demodulates the TDM signals of 12.214 to 12.239 GHz received from the satellite 100, and then modulates them into CDM (Code Division Multiplex) signals of 2.630 to 2.665 GHz to be received by the mobile terminal in a multiple fading environment such as a city or metropolis.

The DMB receiving terminal 106 may be a personal mobile terminal, vehicle-mounted wireless terminal, or fixedly mounted communications set to receive the signals directly from the satellite 100 or through the terrestrial radio station or gap filler 104. The DMB signals received by the DMB receiving terminal 106 directly from the satellite 100 usually have a weak level. If the DMB receiving terminal 106 is far away from a metropolis with the gap filler 104, it can only receive the signals from the satellite. Accordingly the region where the signals can received only from the satellite 100 is called a weak electromagnetic field region. The DMB signals received in the weak electromagnetic field region have a signal level of about −30 dBm to −100 dBm. On the contrary, if the DMB receiving terminal 106 is in a metropolis with the gap filler 104 or near to it, it can receive high-level DMB signals from the gap filler 104. Accordingly the region where the DMB signals can be received from the gap filler 104 is called a strong electromagnetic field region. The DMB signals received in the strong electromagnetic field region have a signal level of about several tens to −50 dBm. Hence, it is necessary that the DMB receiving terminal 106 cover a wide range of signal levels extending from the strong electromagnetic field region to the weak electromagnetic field region.

In addition, the DMB receiving terminal 106 receives services from terrestrial DMB center 108 in the frequency band of 204 to 210 MHz. Thus, DMB services may be provided by both satellite and terrestrial broadcasting. Nevertheless, if the user of a DMB receiving terminal presently receiving satellite or terrestrial DMB services enters a weak electromagnetic field region, the DMB receiving terminal cannot receive the DMB signals, thus terminating the process of receiving the DMB services without providing advance notification of impossibility of receiving services. More specifically, because the DMB receiving terminal capable of receiving both satellite and terrestrial broadcasting can basically operate in terrestrial mode in a satellite weak electromagnetic field region, and in satellite mode in a terrestrial weak electromagnetic field region, it does not have to terminate the process of receiving the DMB services even if it enters either a satellite or terrestrial weak electromagnetic region when operating in either satellite or terrestrial mode. However, a conversion DMB receiving terminal will likely stop receiving the DMB services if it enters either satellite or terrestrial weak electromagnetic region when operating in either satellite or terrestrial mode.

SUMMARY OF THE INVENTION

It is an object of the present invention to provide a method and apparatus for receiving DMB services in a weak electromagnetic field region.

It is another object of the present invention to provide a method for switching a DMB receiving apparatus from the satellite mode to the terrestrial mode if the apparatus enters a satellite weak electromagnetic region when operating in the satellite mode and terrestrial DMB services may be received in that region.

It is still another object of the present invention to provide a method for switching a DMB receiving apparatus from the terrestrial mode to the satellite mode if the apparatus enters a terrestrial weak electromagnetic region when operating in the terrestrial mode and satellite DMB services may be received in that region.

According to an aspect of the present invention, a DMB receiving apparatus for receiving DMB (Digital Multimedia Broadcasting) services in a weak electromagnetic field region, includes a first DMB receiver for receiving first DMB packet data, a second DMB receiver for receiving second DMB packet data, a packet judgment unit for distinguishing the packet data received from the first and second DMB receivers into the first and the second DMB packet data, and a control unit for notifying the user of the DMB receiving apparatus of possibility of switching the apparatus from first to second DMB receiving mode if there occurs an event preventing the reception of the first DMB packet data during the first DMB receiving mode and the packet judgment unit detects the second DMB packet data, wherein the control unit switches the apparatus to the second DMB receiving mode according to a user switching request.

According to another aspect of the present invention, a method for receiving DMB services with a DMB receiving apparatus capable of operating both in first DMB receiving mode and in second DMB receiving mode in a weak electromagnetic field region, includes setting the DMB receiving apparatus to the first DMB receiving mode both to receive first DMB packet data and to detect second DMB packet data, checking detection of the second DMB packet data if there occurs an event preventing the reception of the first DMB packet data during the first DMB receiving mode, notifying the user of the DMB receiving apparatus of possibility of switching the apparatus from the first to the second DMB receiving mode if the second DMB packet data is detected, and switching the DMB receiving apparatus from the first to the second DMB receiving mode according to a user switching request.

BRIEF DESCRIPTION OF THE DRAWINGS

The above and other objects, features and advantages of the present invention will become more apparent from the following detailed description when taken in conjunction with the accompanying drawing in which.

DETAILED DESCRIPTION OF THE PREFERRED EMBODIMENTS

Figure 1:
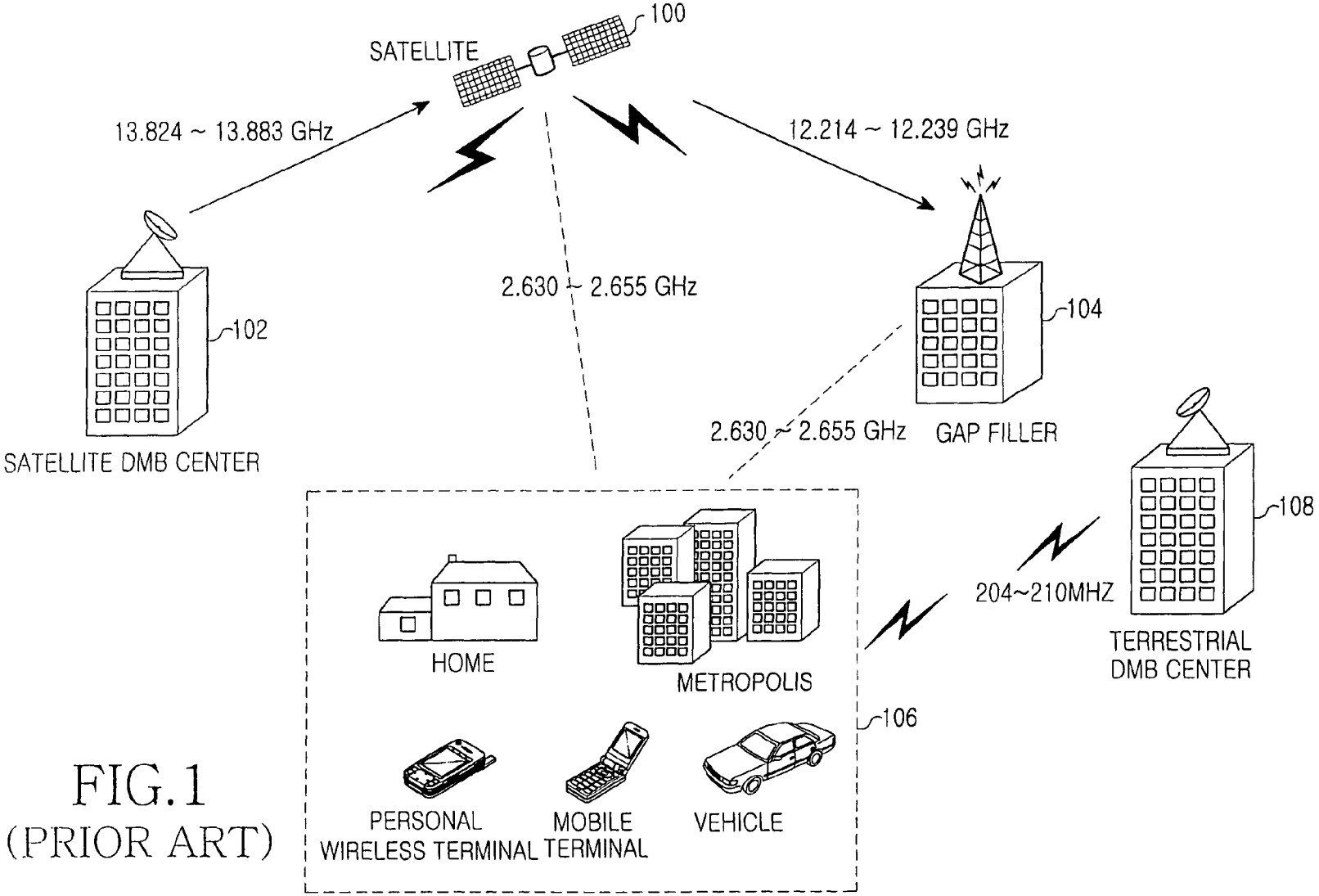
FIG.1 (PRIOR ART)
FIG. 1 is a diagram of a conventional DMB system.

Preferred embodiments of the present invention will be described below with reference to the accompanying drawings. In the drawings, the same or similar elements are denoted by the same reference numerals even though they are depicted in different drawings. In the following description, well-known functions or constructions are not described in detail to avoid obscuring the invention with unnecessary detail.

Figure 2:
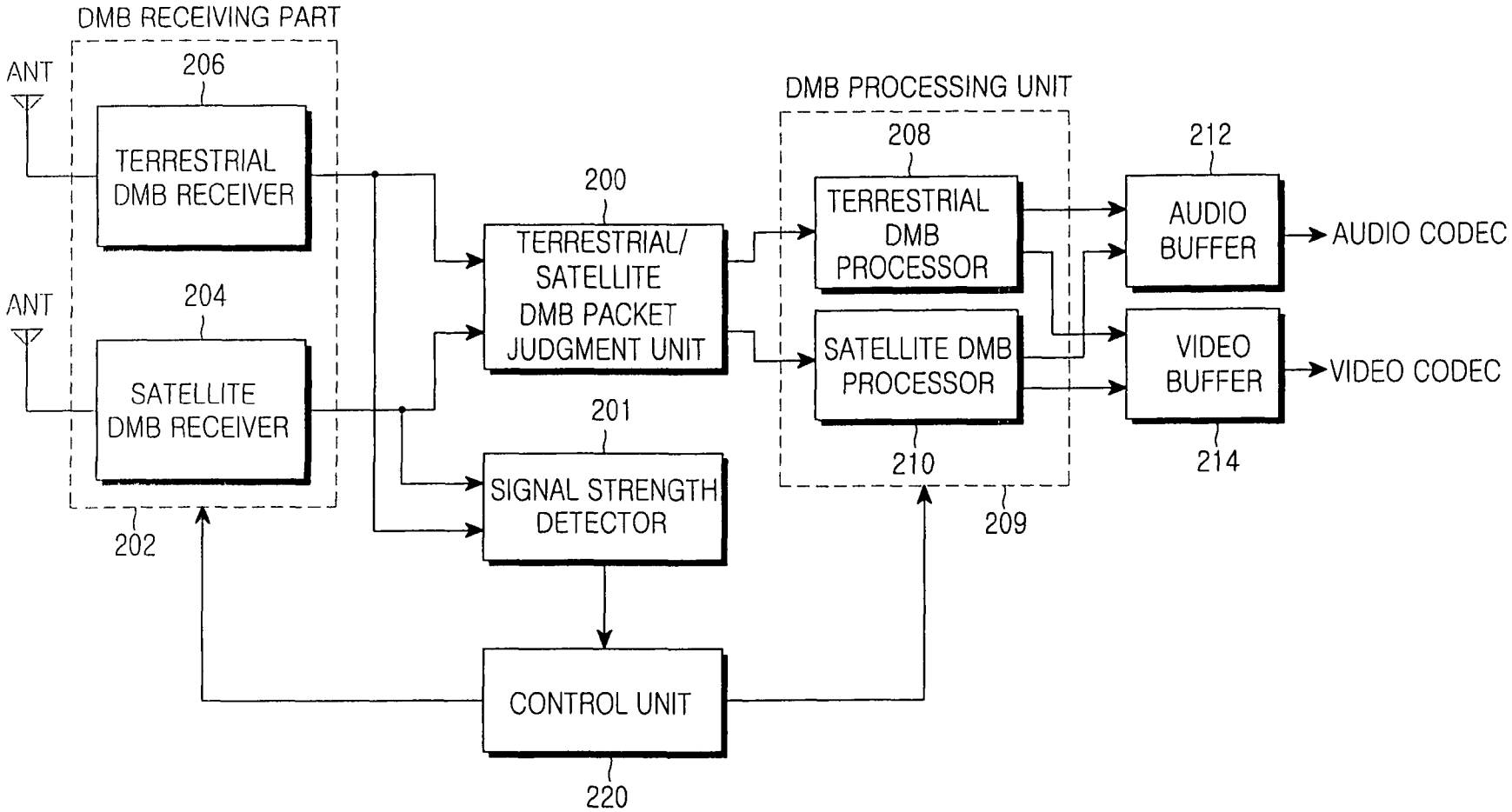
FIG. 2 is a block diagram for showing the structure of a DMB receiving terminal used for the present invention.

Referring to FIG. 2, a DMB receiving terminal or apparatus of the present invention includes a DMB receiving part 202, terrestrial/satellite DMB packet judgment unit 200, signal strength detector 201, control unit 220, DMB processing unit 209, audio buffer 212, and video buffer 214.

The DMB receiving part 202 receives the DMB signals delivered to the DMB processing unit 209 under the control of the control unit 220. The DMB receiving part 202 includes a terrestrial DMB receiver 206 for receiving terrestrial DMB packet data through an antenna and a satellite DMB receiver 204 for receiving satellite DMB packet data through an antenna.

The terrestrial/satellite DMB packet judgment unit 200 checks the packet data received from the DMB receiving part to determine whether the packet data from the DMB receiving part 202 is the terrestrial packet data from the terrestrial DMB receiver 206 or the satellite packet data from the satellite DMB receiver 204, so that the terrestrial packet data from the terrestrial DMB receiver 206 is delivered to a terrestrial DMB processor 208 and the satellite packet data from the satellite DMB receiver 204 to a satellite DMB processor 210. The signal strength detector 201 detects the strength of the signals received from the DMB receiving part 202 delivered to the control unit 220.

The control unit 220 controls the whole functions of the DMB receiving terminal 106, and, according to the present invention, notifies the user of the DMB receiving terminal of the possibility of switching the terminal from satellite DMB receiving mode to terrestrial DMB receiving mode if an event prevents reception of the satellite DMB packet data during the satellite DMB receiving mode and the terrestrial/satellite packet judgment unit 200 detects the terrestrial DMB packet data, and then switches the terminal to the terrestrial DMB receiving mode according to a user switching request.

The DMB processing unit 209 decodes the DMB signals received from the DMB receiving part 202 under the control of the control unit 220 according to the key data inputted by a key input device (not shown). Specifically the DMB processing unit 209 comprises terrestrial DMB processor 208 and satellite DMB processor 210 for respectively decoding the terrestrial and satellite DMB packet data received from the terrestrial/satellite packet judgment unit 200. The video data and audio of the decoded DMB packet data are respectively delivered through a video buffer 214 and audio buffer 212 to their respective codecs.

Figure 3:
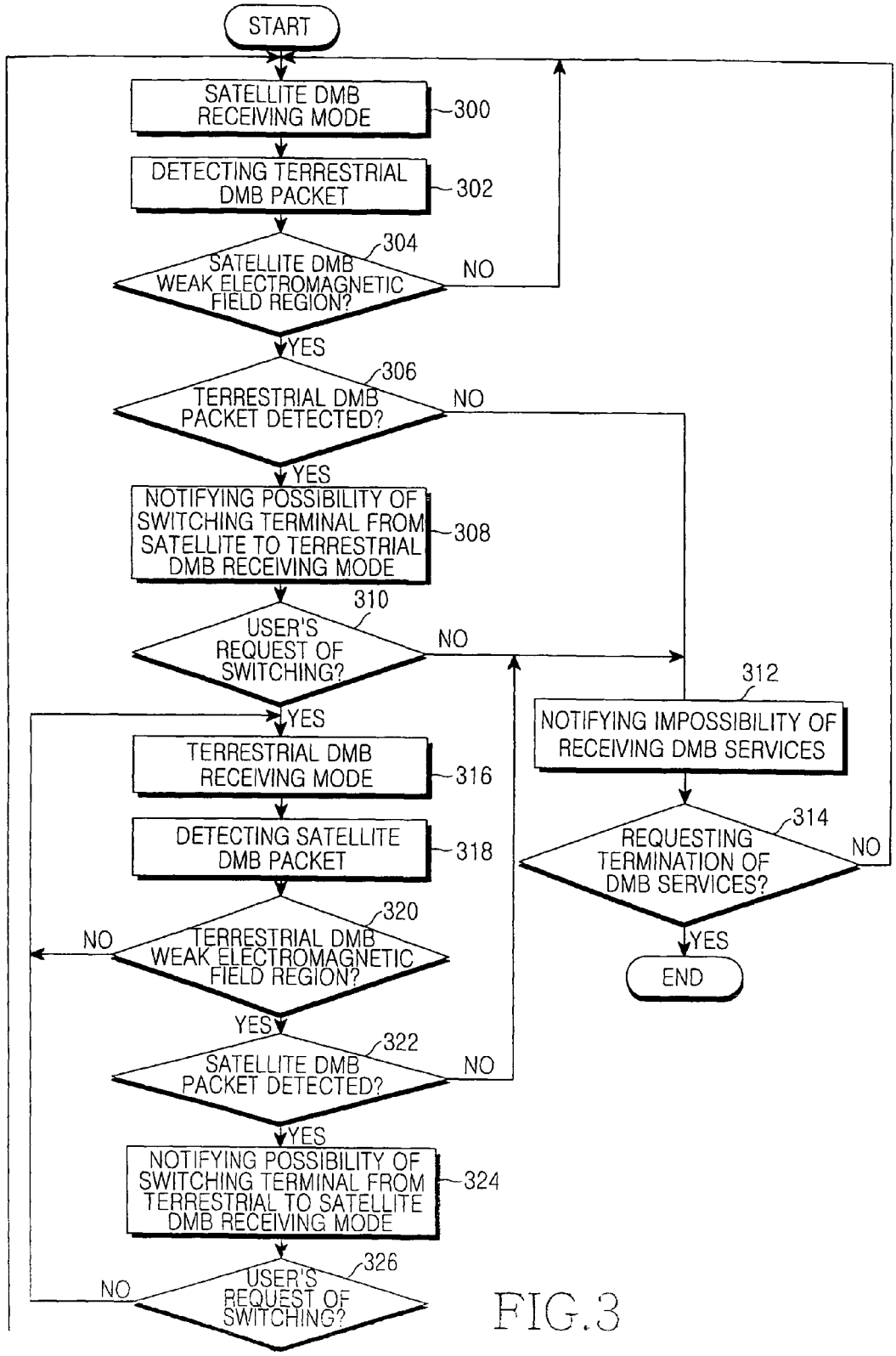
FIG. 3 is a flowchart illustrating the operation of a DMB receiving terminal in a weak electromagnetic region according to the present invention.

FIG. 3 illustrates operation of the DMB receiving terminal 106 when having entered a weak electromagnetic field region during the satellite DMB receiving mode. Referring to FIG. 3, a description is provided of a process of continuously receiving the DMB services even when the terminal has entered a weak electromagnetic field region during operation in the satellite or terrestrial DMB receiving mode.

In step 300, the DMB receiving terminal 106 is set to the satellite DMB receiving mode. The control unit 220 of the DMB receiving terminal 106 controls the terrestrial DMB receiver 206 and satellite DMB receiver 204 to output the DMB packet data to the terrestrial/satellite packet judgment unit 200. In this case, the DMB receiving part 202 may change the header of the DMB packet data in order to distinguish the satellite and the terrestrial DMB packet data. For example, the satellite DMB receiver 204 maintains sync bytes of the satellite DMB packet data as "0×47" while the terrestrial DMB receiver 206 inserts a different number into the sync bytes of the terrestrial DMB packet data. Thus, the terrestrial/satellite packet judgment unit 200 distinguishes in step 302 the satellite and the terrestrial DMB packet data by checking the sync bytes contained in the packet data received from the terrestrial/satellite DMB receivers 204 and 206.

In steps 300 to 302, if the user sets the DMB receiving terminal to the satellite DMB receiving mode for receiving the satellite DMB services in step 300, the terminal detects in step 302 the DMB packet of an RF-locked terrestrial DMB ensemble received on the background. In this case, the term "ensemble" means multiplexing multiple service components defined in "UHF Digital Radio Broadcasting Transmission and Reception Matching Standard" on a single physical transmission channel with a bandwidth of 1.536 MHz. Subsequently, the terrestrial/satellite (TS) packet received is delivered to the terrestrial/satellite packet judgment unit 200 to determine whether it is possible to receive the terrestrial DMB packet. If the terrestrial DMB packet is received, the next RF-fixed ensemble is checked to detect another TS packet. Likewise, all the ensembles are checked to repeatedly detect the terrestrial DMB packet data, thereby generating a list of the channels presently capable of providing the terrestrial DMB services.

In step 304, the control unit 220 controls the signal strength detector 201 to check the strength of the present satellite DMB signals to be below a threshold value in order to determine whether the DMB receiving terminal is in a weak electromagnetic field region. If the DMB receiving terminal has entered a weak electromagnetic field region, the control unit 220 proceeds to step 306, or otherwise returns to step 300 to continue the satellite DMB receiving mode. In step 306, the control unit 220 controls the terrestrial/satellite packet judgment unit 200 to determine whether terrestrial DMB packet data is detected.

Figure 4A:
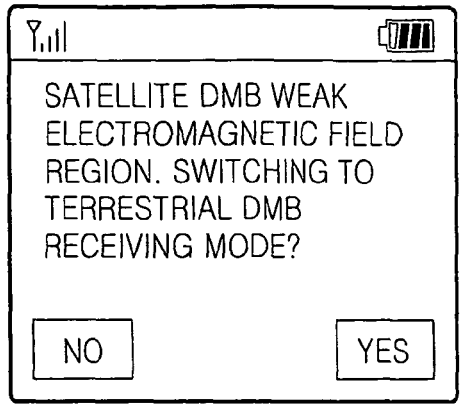
FIGS. 4A to 4C are display screens of a DMB receiving terminal displaying important operation phases according to the present invention.
Figure 4B:
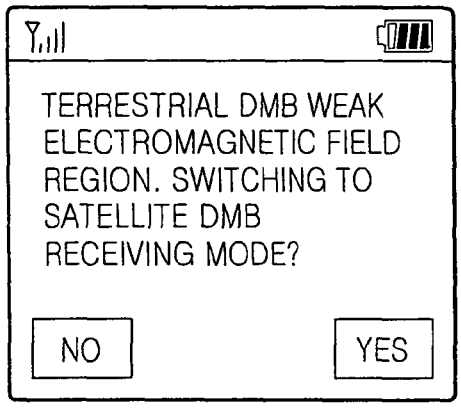
Figure 4C:
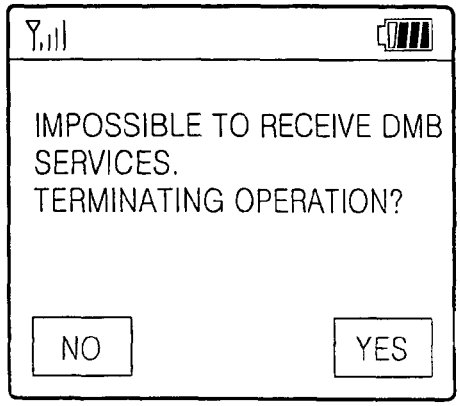

If the terrestrial DMB packet data is detected in the step 306, the process goes to step 308. The process otherwise goes to step 312 to notify the user that the terminal is in a region presently incapable of receiving the DMB services. When DMB packet data is not detected, the terminal may display on the screen a message of "Impossible to receive DMB. Operation terminated?", as shown in FIG. 4C. Subsequently, the control unit 220 may terminate the process in step 314 according to the user's request, or otherwise returns to step 300 to continue the satellite DMB receiving mode. However, returning to step 300 will not permit the user to enjoy the DMB services if the terminal travels out of a satellite weak electromagnetic field region incapable of providing the DMB services. Of course, if the terminal moves outside the satellite weak electromagnetic field region, it can provide the user with the DMB services.

Alternatively, if at step 306 of terrestrial DMB packet data, the control unit 220 proceeds to step 308 to notify the user of a possibility of switching the terminal from the satellite DMB receiving mode to the terrestrial DMB receiving mode. In this case, it may provide the terrestrial DMB channel information generated in step 302 of detecting the terrestrial DMB packet together with the notification of the switching. This enables the user to enjoy the terrestrial DMB services in a satellite weak electromagnetic field region. For example, the terminal may display on the screen a message of "Satellite DMB weak electromagnetic field region. Switching to terrestrial DMB receiving mode?" as shown in FIG. 4A.

Subsequently, if the control unit 220 detects in step 310 a user request for switching the terminal from the satellite to the terrestrial DMB receiving mode, it proceeds to step 316, or otherwise to step 312 to notify the user of impossibility of providing the satellite DMB services. If the user inputs a request of termination in step 314, the control unit 220 terminates the operation, or otherwise returns to the step 300 to continue the satellite DMB receiving mode, as described above.

Meanwhile, if step 310 indicates the user request for switching, the control unit 220 proceeds to step 316 to switch the terminal to the terrestrial DMB receiving mode, and then to step 318 to detect satellite DMB packet data. More specifically describing the steps 316 to 318, if the user switches the DMB receiving terminal to the terrestrial DMB receiving mode for receiving the terrestrial DMB services in step 316, the terminal detects in step 318 the DMB packet of an RF-locked satellite DMB ensemble received on the background. Subsequently, the terrestrial/satellite (TS) packet received is delivered to the terrestrial/satellite packet judgment unit 200 to determine whether it is possible to receive the satellite DMB packet. If the satellite DMB packet is received, the next RF-fixed ensemble is checked to detect another TS packet. Likewise, all the ensembles are checked to repeatedly detect the satellite DMB packet data, thereby generating a list of the channels presently capable of providing the satellite DMB services.

In step 320, the control unit 220 controls the signal strength detector 201 to check whether the present terrestrial DMB signal strength is below the threshold value in order to determine whether the DMB receiving terminal is in a weak electromagnetic field region. If the DMB receiving terminal has entered a weak electromagnetic field region, the control unit 220 proceeds to step 322, or otherwise returns to step 316 to continue the terrestrial DMB receiving mode. In step 322, the control unit 220 controls the terrestrial/satellite packet judgment unit 200 to determine whether satellite DMB packet data is detected.

If the satellite DMB packet data is detected in the step 322, the process goes to step 324. The process otherwise goes to step 312 to notify the user that the terminal is in a region presently incapable of receiving the DMB services. Subsequently, the control unit 220 terminates the process in step 314 according to the user's request, or otherwise returns it to the step 300 to continue the satellite DMB receiving mode. However, returning to the step 300 may not allow the user to enjoy the DMB services unless the terminal moves outside the satellite weak electromagnetic field region. Meanwhile, if the weak electromagnetic field region cannot receive both satellite and terrestrial DMB services, the terminal may continue the presently set DMB receiving mode, or switch to another DMB receiving mode according to the user's request.

Alternatively, if at step 322 satellite DMB packet data is detected, the control unit 220 proceeds to step 324 to notify the user of possibility of switching the terminal from the terrestrial DMB receiving mode to the satellite DMB receiving mode. In this case, it may provide the satellite DMB channel information generated in the step 318 of detecting the satellite DMB packet together with the notification of the switching. This enables the user to enjoy the satellite DMB services in a terrestrial weak electromagnetic field region. For example, the terminal may display on the screen a message of "Terrestrial DMB weak electromagnetic field region. Switching to satellite DMB receiving mode?", as shown in FIG. 4B.

Subsequently, if the control unit 220 detects in step 326 the user's request of switching the terminal from the terrestrial to the satellite DMB receiving mode, it returns to step 300 to perform the satellite DMB receiving mode, or otherwise to step 316.

As described above, the invention enables the user to continuously enjoy DMB services by switching the DMB receiving terminal between terrestrial and satellite DMB receiving modes even when the terminal enters a terrestrial or satellite weak electromagnetic region during its operating in one of the two DMB receiving modes.

While the invention has been shown and described with reference to a certain preferred embodiment thereof, it will be understood by those skilled in the art that various changes in form and details may be made therein without departing from the spirit and scope of the invention. For example, the invention may be applied to European type DVB-H, Qualcomm Media Flow, Chinese type DMB, etc.

What is claimed is:

1. A DMB receiving apparatus for receiving DMB (Digital Multimedia Broadcasting) services in a weak electromagnetic field region, comprising:

a first DMB receiver for receiving first DMB packet data;

a second DMB receiver for receiving second DMB packet data;

a packet judgment unit for distinguishing the packet data received from said first and second DMB receivers into the first and the second DMB packet data; and a control unit for notifying a user of a possibility of switching from a first to a second DMB receiving mode if an event occurs preventing reception of said first DMB packet data during the first DMB receiving mode and said packet judgment unit detects the second DMB packet data, wherein said control unit switches said apparatus to the second DMB receiving mode according to a user switching request, wherein the first DMB receiver inserts a value representing a first DMB packet into sync bytes of received first DMB packet data, and the second DMB receiver inserts a value representing a second DMB packet into sync bytes of received second DMB packet data.

2. The DMB receiving apparatus as defined in claim 1 for receiving DMB services in a weak electromagnetic field region, wherein said control unit notifies the user of a possibility of switching said apparatus from the second to the first DMB receiving mode if an event occurs preventing the reception of said second DMB packet data during the second DMB receiving mode and said packet judgment unit detects the first DMB packet data, wherein said control unit switches said apparatus to the first DMB receiving mode according to the user switching request.

3. The DMB receiving apparatus as defined in claim 1 for receiving DMB services in a weak electromagnetic field region, wherein said packet judgment unit checks the sync bytes of the packet data received from at least one of the first and second DMB receivers to determine whether the received packet data is the first DMB packet data or the second DMB packet data.

4. The DMB receiving apparatus as defined in claim 1 for receiving DMB services in a weak electromagnetic field region, wherein the event that occurs preventing the reception of said first DMB packet data signifies said DMB receiving apparatus existing in a weak electromagnetic field region.

5. The DMB receiving apparatus as defined in claim 1 for receiving DMB services in a weak electromagnetic field region, wherein said control unit generates a list of broadcasting channels providing the second DMB packet data upon detecting the second DMB packet data during the first DMB receiving mode.

6. The DMB receiving apparatus as defined in claim 5 for receiving DMB services in a weak electromagnetic field region, wherein the user of said DMB receiving apparatus is notified both of the possibility of switching said apparatus from the first to the second DMB receiving mode and of the list of the broadcasting channels providing the second DMB packet data if the event occurs preventing the reception of said first DMB packet data and said packet judgment unit detects the second DMB packet data.

7. The DMB receiving apparatus as defined in claim 1 for receiving DMB services in a weak electromagnetic field region, wherein the user of said DMB receiving apparatus is notified of impossibility of receiving the DMB services if the event occurs preventing the reception of said first DMB packet data during the first DMB receiving mode and said packet judgment unit does not detect the second DMB packet data.

8. The DMB receiving apparatus as defined in claim 1 for receiving DMB services in a weak electromagnetic field region, wherein said control unit generates a list of broadcasting channels providing the first DMB packet data upon detecting the first DMB packet data during the second DMB receiving mode.

9. The DMB receiving apparatus as defined in claim 8 for receiving DMB services in a weak electromagnetic field region, wherein the user of said DMB receiving apparatus is notified both of the possibility of switching said apparatus from the second to the first DMB receiving mode and of the list of the broadcasting channels providing the first DMB packet data if the event occurs preventing the reception of said second DMB packet data and said packet judgment unit detects the first DMB packet data.

10. The DMB receiving apparatus as defined in claim 1 for receiving DMB services in a weak electromagnetic field region, wherein the user of said DMB receiving apparatus is notified of impossibility of receiving the DMB services if the event occurs preventing the reception of said second DMB packet data during the second DMB receiving mode and said packet judgment unit does not detect the first DMB packet data.

11. The DMB receiving apparatus as defined in claim 1 for receiving DMB services in a weak electromagnetic field region, wherein the first DMB receiving mode is a satellite DMB receiving mode, and the second DMB receiving mode is a terrestrial DMB receiving mode.

12. The DMB receiving apparatus as defined in claim 1 for receiving DMB services in a weak electromagnetic field region, wherein the first DMB receiving mode is a terrestrial DMB receiving mode, and the second DMB receiving mode is a satellite DMB receiving mode.

13. A method for receiving DMB services with a DMB receiving apparatus capable of operating both in a first DMB receiving mode and in a second DMB receiving mode in a weak electromagnetic field region, comprising the steps of:

setting said DMB receiving apparatus to the first DMB receiving mode both to receive first DMB packet data and to detect second DMB packet data;

checking detection of the second DMB packet data if an event occurs preventing reception of the first DMB packet data during the first DMB receiving mode;

notifying a user of said DMB receiving apparatus of a possibility of switching said apparatus from the first to the second DMB receiving mode if the second DMB packet data is detected; and switching said DMB receiving apparatus from the first to the second DMB receiving mode according to a user switching request, wherein a value representing a first DMB packet is inserted into sync bytes of the received first DMB packet data by a first DMB receiver, and a value representing a second DMB packet is inserted into bytes of received second DMB packet data by a second DMB receiver.

14. The method for receiving DMB services in a weak electromagnetic field region as defined in claim 13, further comprising:

notifying the user of a possibility of switching said DMB receiving apparatus from the second to the first DMB receiving mode if an event occurs preventing the reception of the second DMB data packet during the second DMB receiving mode and the first DMB data packet is detected; and switching from the second to the first DMB receiving mode according to the user switching request.

15. The method for receiving DMB services that occurs in a weak electromagnetic field region as defined in claim 13, wherein the event preventing the reception of the second DMB data packet signifies said DMB receiving apparatus existing in a weak electromagnetic field region.

16. The method for receiving DMB services in a weak electromagnetic field region as defined in claim 13, further comprising generating a list of broadcasting channels providing the second DMB packet data upon detecting the second DMB packet data during the first DMB receiving mode.

17. The method for receiving DMB services in a weak electromagnetic field region as defined in claim 16, wherein the step of notifying the user of the possibility of switching said apparatus from the first to the second DMB receiving mode if the second DMB packet data is detected includes notifying the list of the broadcasting channels providing the second DMB packet data.

18. The method for receiving DMB services in a weak electromagnetic field region as defined in claim 13, further comprising notifying the user of said DMB receiving apparatus of impossibility of receiving the DMB services if an event occurs preventing the reception of said first DMB packet data during the first DMB receiving mode and the second DMB packet data is not detected.

19. The method for receiving DMB services in a weak electromagnetic field region as defined in claim 13, further comprising generating a list of broadcasting channels providing the first DMB packet data upon detecting the first DMB packet data during the second DMB receiving mode.

20. The method for receiving DMB services in a weak electromagnetic field region as defined in claim 19, further comprising notifying the user of said DMB receiving apparatus both of the possibility of switching said apparatus from the second to the first DMB receiving mode and of the list of the broadcasting channels providing the first DMB packet data if an event occurs preventing the reception of said second DMB packet data and the first DMB packet data is detected.

21. The method for receiving DMB services in a weak electromagnetic field region as defined in claim 20, further comprising notifying the user of said DMB receiving apparatus of impossibility of receiving the DMB services if an event occurs preventing the reception of said second DMB packet data during the second DMB receiving mode and the first DMB packet data is not detected.

22. The method for receiving DMB services in a weak electromagnetic field region as defined in claim 13, wherein the first DMB receiving mode is a satellite DMB receiving mode, and the second DMB receiving mode is a terrestrial DMB receiving mode.

23. The method for receiving DMB services in a weak electromagnetic field region as defined in claim 13, wherein the first DMB receiving mode is a terrestrial DMB receiving mode, and the second DMB receiving mode is a satellite DMB receiving mode.

* * * * *